US007188900B1

(12) United States Patent
Raftery

(10) Patent No.: US 7,188,900 B1
(45) Date of Patent: Mar. 13, 2007

(54) FLEXIBLE SUPPORT FOR A CHAIR BACKREST

(75) Inventor: William B Raftery, Canton, OH (US)

(73) Assignee: HNI Technologies Inc., Muscatine, IA (US)

( * ) Notice: Subject to any disclaimer, the term of this patent is extended or adjusted under 35 U.S.C. 154(b) by 297 days.

(21) Appl. No.: 10/715,234

(22) Filed: Nov. 17, 2003

(51) Int. Cl.
*A47C 3/00* (2006.01)

(52) U.S. Cl. ..... 297/286; 297/323

(58) Field of Classification Search ..... 297/285, 297/286, 323, 316, 300.2, 319, 320
See application file for complete search history.

(56) References Cited

U.S. PATENT DOCUMENTS 4,131,315 A 12/1978 Vogtherr
4,703,974 A * 11/1987 Brauning ..... 297/285
4,832,406 A 5/1989 Adams et al.
4,911,501 A * 3/1990 Decker et al. ..... 297/285
5,909,923 A 6/1999 DeKraker
5,984,408 A 11/1999 Bujaryn
6,070,937 A * 6/2000 Ginat ..... 297/286 X
6,367,876 B2 * 4/2002 Caruso et al. ..... 297/300.2 X
6,367,877 B1 4/2002 Knoblock et al.
6,523,898 B1 2/2003 Ball et al.
6,557,939 B1 * 5/2003 Brauning ..... 297/316
6,568,760 B2 5/2003 Davis et al.
2003/0047982 A1 3/2003 Ball et al.

* cited by examiner

*Primary Examiner*—Anthony D. Barfield
(74) *Attorney, Agent, or Firm*—Faegre & Benson LLP

(57) ABSTRACT

A chair having an arm, a backrest and a flexible backrest support that is rigidly attached to the arm and the backrest. The flexible backrest support includes a spring located between rigid end portions that are mounted to the chair arm and backrest. The flexible backrest support allows the backrest to pivot while the arm remains stationary. Optionally, a supplemental backrest support may be included.

15 Claims, 3 Drawing Sheets

FLEXIBLE SUPPORT FOR A CHAIR BACKREST

BACKGROUND OF THE INVENTION

The invention relates generally to chairs, and more particularly to a structure for supporting a chair backrest.

BRIEF DESCRIPTION OF THE DRAWINGS

The present invention will hereinafter be described in conjunction with the appended drawing figures wherein like numerals denote like elements.

DETAILED DESCRIPTION OF THE PREFERRED EMBODIMENTS

Figure 1:
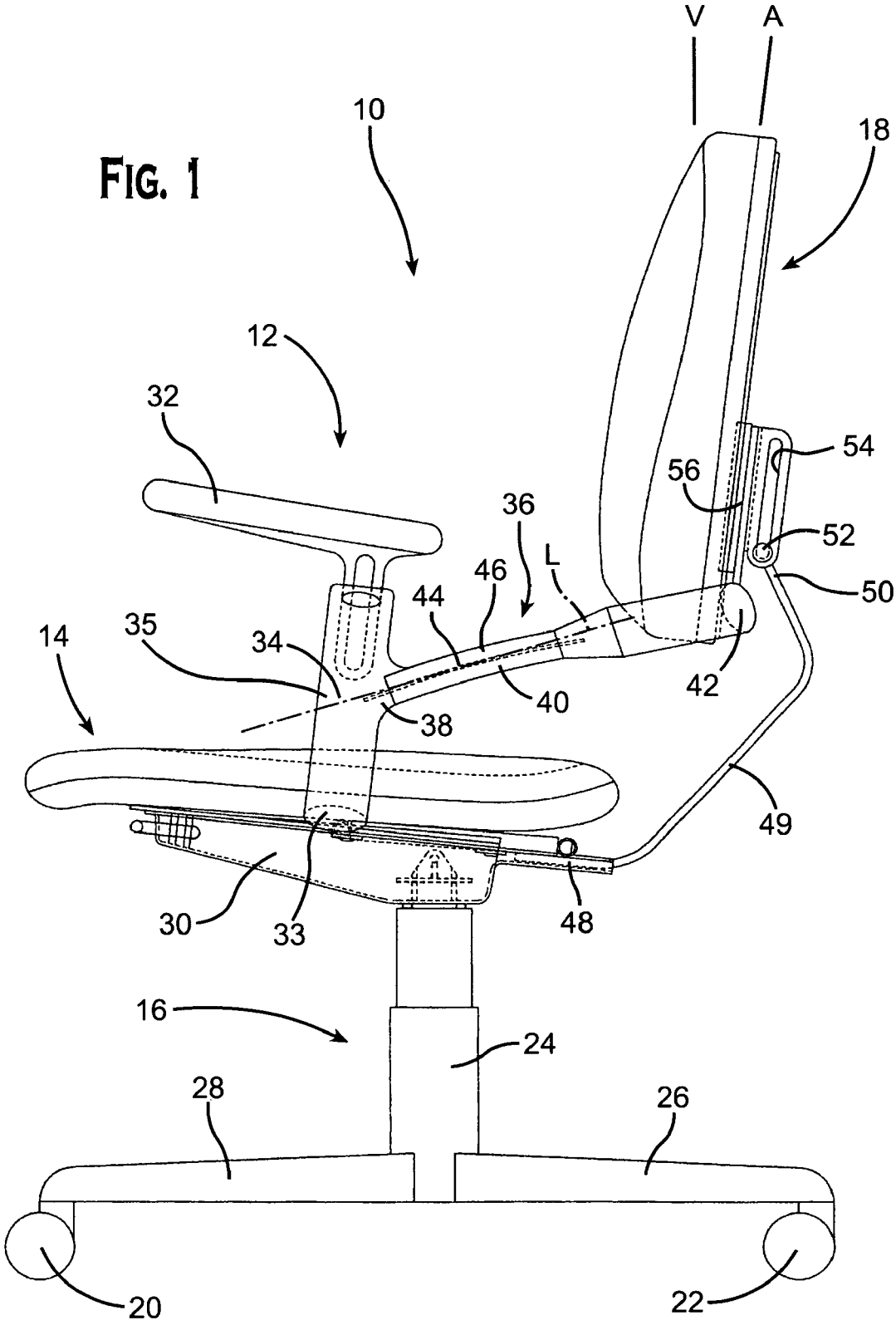
FIG. 1 is a right side view of a chair showing the flexible backrest support of the present invention.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

To aid in describing the invention, directional terms used in the specification and claims to describe portions of the chair 10 of the present invention (e.g., upper, lower, left, right, etc.) reflect the orientation the chair 10 in the drawing figures. These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features. Except where a preferred material is specifically identified, the preferred material(s) for features described herein are conventional and known in the art.

FIG. 1 shows a preferred embodiment of the chair 10 of the present invention, which includes an arm 12, a seat 14, a base 16 and a backrest 18. The armrest 12 shown in the figures is the left arm. A right arm is, of course, included but is not shown in order to simplify the drawing figures. It should be understood that any features described in relation to the left arm 12 are also present as a mirror image in the right arm.

The base 16 comprises a stem 24, which may optionally include a height adjustment. The stem 24 is supported by a plurality of legs 26, 28, each having an attached caster 20, 22 to allow the chair to roll. Although only two legs 26, 28 are shown in FIG. 1, typically, between three and six legs are provided. A mounting bracket 30 sits atop the stem 24 and is secured to the seat 14 by any suitable means, such as bolts, screws, rivets, etc.

The arm 12 includes an armrest 32, which is preferably height-adjustable and attached to an armrest support 34. The armrest support 34 includes lateral portion 33 that is rigidly affixed to the base 16, preferably at the seat mounting bracket 30, and an upright portion 35 extending upwardly from the lateral portion 33.

In accordance with the present invention, a backrest support 36 extends from the upright portion 35 of the armrest support 34 to the backrest 18. The backrest support 36 includes a fixed armrest mount 38, a fixed backrest mount 42 and a semi-rigid, but flexible center portion 40, which allows the backrest support 36 and, in turn, the backrest 18 to pivot. The armrest mount 38 is rigidly affixed to the armrest support 34 about midway between the armrest 32 and the lateral portion 33 of the armrest support 34. The backrest mount 42 is rigidly affixed to the backrest 18. The design of the backrest support 36 allows the backrest 18 to pivot, while the arm 12 remains stationary (i.e., does not pivot).

When no external loads are applied, the backrest 18 rests at an unloaded (upright) position A, which is preferably a few degrees rearward (in this embodiment, about 6 degrees) from a vertical position V. When a load is applied (i.e., by a user leaning back against the backrest 18), the flexible center portion 40 flexes. This allows the backrest 18 to pivot rearward to, for example, a loaded (or reclined) position B (see FIG. 2). The pivoting characteristics of the backrest 18, of course, depend upon the flexural stiffness and length of the flexible center portion 40.

Figures 2, 3:
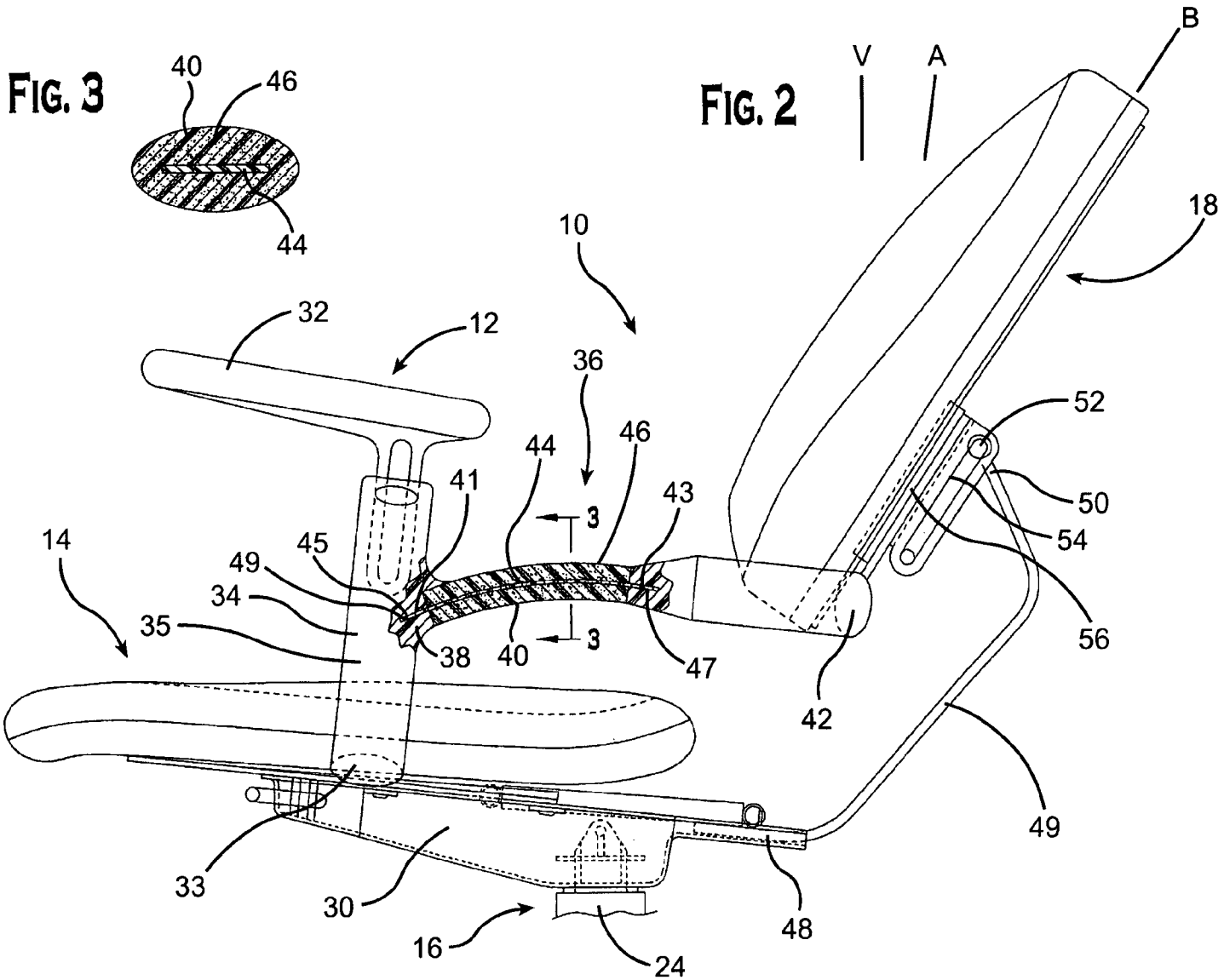
FIG. 2 is a partial sectional view of the chair of FIG. 1, showing the internal structure of the flexible backrest support.
FIG. 3 is a right side view of the chair shown in FIG. 1, showing a partial sectional view of the flexible backrest support portion of the chair.

Referring to FIGS. 2 & 3, the primary flexural strength of the flexible member 40 is provided by a spring 44 having forward and rearward ends 41, 43. In this embodiment, the spring 44 is bar-shaped and rectangular in cross-section and is made from a semi-rigid layered fibrous material, such as Scotchply™ brand epoxy products manufactured by the 3M Company. This material is preferred due to its light weight, reasonable cost, and resistance to cracking and fatigue. Other materials, such as spring steel, other plastics or wood could be substituted for the layered fiberglass material. The forward end 41 of the spring 44 is secured in a complimentarily-shaped slot 45 in the armrest support 34. Similarly, the rearward end 43 of the spring 44 is secured in a complimentarily-shaped slot 47 in the backrest mount 42. Each of the ends 41, 43 of the spring 44 can be secured using any convenient means, such as adhesive, for example.

A cover 46 made of an aesthetically pleasing material is preferably provided to enhance the appearance of the flexible center portion 40. In this embodiment, the cover 46 is molded polyurethane having an oval cross-sectional shape (see FIG. 3). However, other suitable materials and/or shapes could be used.

The spring 44 is preferably pre-stressed, meaning that the cover 46 is molded so that the spring 44 is flexed slightly even when the backrest 18 is in the upright position A. Without such pre-stressing, the backrest 18 would pivot from the upright position A using too little force and would be less stable on the upright position A.

As shown in FIG. 2, the flexible center portion 40 is preferably linear in longitudinal configuration. "Linear in longitudinal configuration" as used here and in the claims is intended to mean that the spring 44 does not loop around itself (as is the case with a coiled spring) along its longitudinal axis L (see FIG. 1). In the preferred embodiment, the rearward end 43 of the spring 44 bends no more than 25 degrees from the longitudinal axis L when the backrest 18 is in a reclined position B. In the upright position A and pre-stressed, the rearward end 43 of the spring 44 bends less than 5 degrees from the longitudinal axis L.

The backrest support 36 itself is also generally horizontal in orientation, meaning that the longitudinal axis L is oriented at an angle less than 45 degrees from horizontal.

Returning to FIG. 1, an optional supplemental backrest support 46 is shown. The lower end 48 of the supplemental support 49 is rigidly affixed to the mounting bracket 30. The upper end 50 of the supplemental support 49 comprises a rod 52 that slides along a slot 54 formed in a bracket 56. The bracket 56 is affixed to the rear side of the backrest 18. In this embodiment, the supplemental support 49 provides additional flexural stiffness when the backrest 18 is pivoted, helps keep the backrest 18 aligned vertically as it pivots and effectively limits pivoting of the backrest beyond the angles at which the rod 52 is in the lowermost (fully upright—FIG. 1) and uppermost (fully reclined—FIG. 2) positions on the slot 52. Substantial additional force is required to pivot the backrest beyond the fully reclined position. Other structures could be substituted for the rod 52 and slot 54 design of the supplemental support 49 disclosed in this embodiment. Such alternative structures could include a roller and track, a rack and gear, or a ball and roller, for example.

Figure 4:
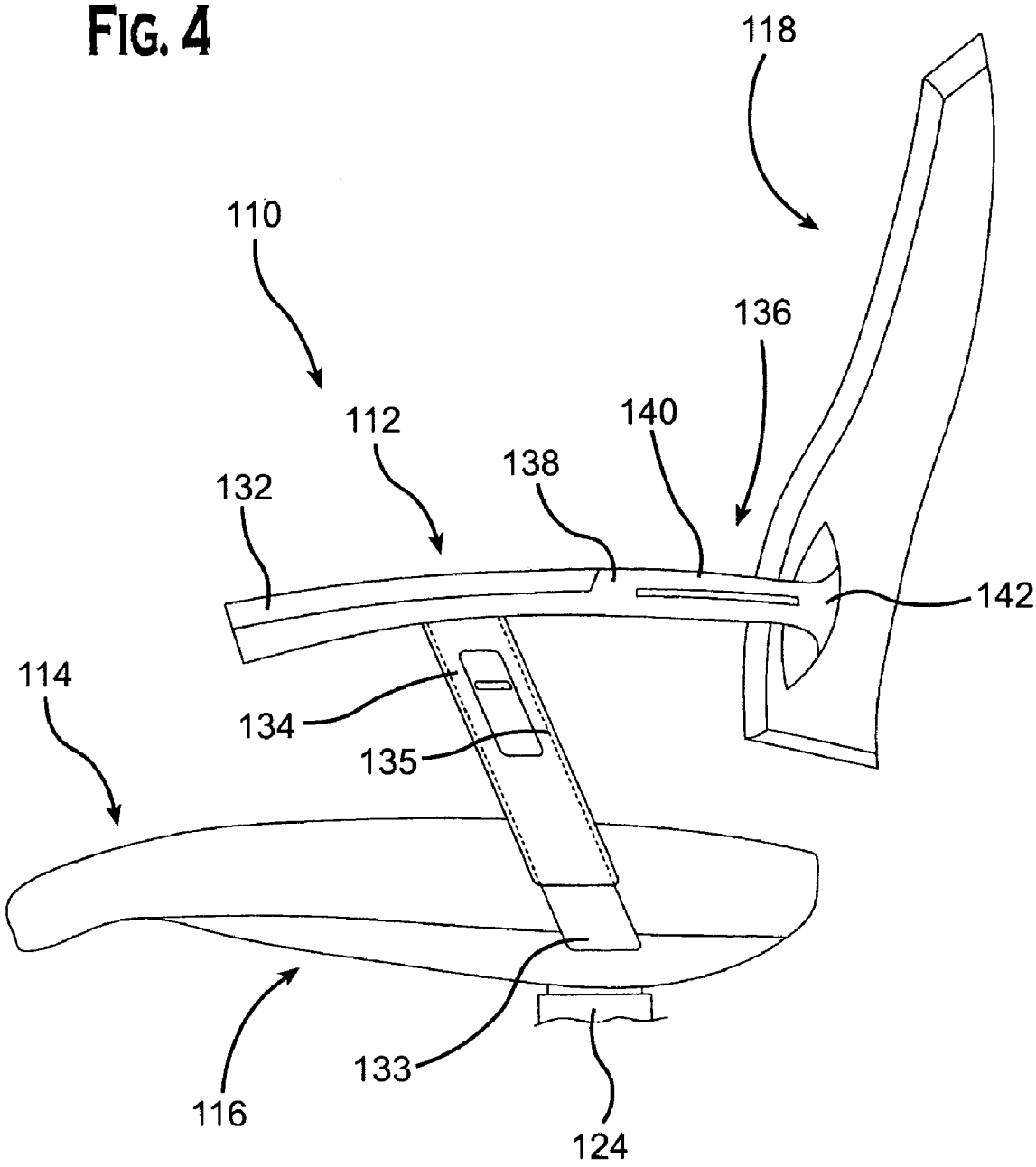
FIG. 4 is a partial right side view of an alternative flexible backrest support design.

An alternate embodiment of the present invention, chair 110, is shown in FIG. 4. In this embodiment, elements shared with the first embodiment (chair 10) are represented by reference numerals increased by factors of 100. For example, the base 16 in FIGS. 1–2 corresponds to the base 116 in FIG. 4. In the interest of clarity, some features of this embodiment that are shared with the first embodiment are numbered in FIG. 4, but are not repeated in the specification.

This chair 110 includes a backrest support 136 having an armrest support mount 138 that is attached directly to the armrest 132. As can be seen in FIG. 4, the armrest 132 and backrest support 136 are configured to provide a smooth, continuous surface from the armrest 132 to the backrest 118. In this embodiment, there is no supplemental backrest support, which means that the backrest support 136 provides the sole support to the backrest 118. In other respects, the chair 110 of the alternate embodiment is very structurally similar to chair 10 of the first embodiment.

Other modifications of the chair 110 are possible. For example, the backrest support 136 could be rigid (i.e., having a center portion 140 that is much more rigid than the flexible center portion 40 of the chair 10 shown in FIGS. 1–3). In addition, the chair 110 could include an armrest height adjustment (not shown), which would allow for simultaneous adjustment of the armrest 132 and backrest 118.

While the principles of the invention have been described above in connection with preferred embodiments, it is to be clearly understood that this description is made only by way of example and not as a limitation of the scope of the invention.

The invention claimed is:

1. A chair comprising:

a seat attached to a base;

a backrest;

first and second arms, each including an armrest, an armrest support, and a backrest support rigidly connected to the armrest support and the backrest, wherein the backrest support includes an armrest mount that rigidly attaches the backrest support to the armrest and a backrest mount that rigidly attaches the backrest support to the backrest;

the backrest support having a flexible center portion comprising a pre-stressed spring element that enables the backrest to pivot by bending the flexible center portion, wherein the pre-stressed spring element includes a first end that is embedded in the armrest mount and a second end is embedded in the backrest mount.

2. The chair of claim 1, wherein the pre-stressed spring element is made from a layered fibrous material.

3. The chair of claim 1, wherein the pre-stressed spring element is contained within a cover.

4. The chair of claim 1, wherein the backrest pivots by bending the pre-stressed spring element.

5. The chair of claim 1, further comprising a supplemental backrest support having a first end that is rigidly attached to the base, and a second end that contacts the backrest.

6. The chair of claim 5 wherein the second end of the backrest support comprises a bracket rigidly mounted to the backrest and a rod, the bracket having a slot formed therein along which the rod slides.

7. The chair of claim 1, wherein the backrest support of each of the first and second arms provides the sole support for the backrest.

8. The chair of claim 1, wherein a supplemental backrest support provides additional support for the backrest.

9. The chair of claim 1, wherein the arm and armrest support of each of the first and second arms remain stationary when the flexible center portion of each of the first and second arms bends.

10. The chair of claim 1, wherein the pre-stressed spring includes a longitudinal axis and is linear in longitudinal configuration.

11. A chair comprising:

a seat attached to a base;

a backrest;

first and second arms, each including an armrest, an armrest support, and a backrest support rigidly connected to the armrest support and the backrest, wherein the backrest support includes an armrest mount that rigidly attaches the backrest support to the armrest and a backrest mount that rigidly attaches the backrest support to the backrest; and the backrest support having a flexible center portion comprising a pre-stressed spring element that enables the backrest to pivot by bending the flexible center portion;

wherein the pre-stressed spring element includes a first end that is embedded in the armrest mount and a second end is embedded in the backrest mount;

wherein the arm and armrest support of each of the first and second arms remain stationary when the flexible center portion of each of the first and second arms bends.

12. A chair comprising:

a seat attached to a base;

a backrest; and first and second arms, each including an armrest, an armrest support, and a backrest support rigidly mounted directly to the armrest and to the backrest;

wherein the backrest support includes an armrest mount that rigidly attaches the backrest support to the armrest and a backrest mount that rigidly attaches the backrest support to the backrest;

the backrest support comprising a pre-stressed spring element; and wherein the pre-stressed spring element includes a first end that is embedded in the armrest mount and a second end is embedded in the backrest mount;

wherein the backrest support comprises the sole support for the backrest.

13. The chair of claim 12, wherein the armrest and backrest support form a continuous surface.

14. The chair of claim 12, further comprising an armrest height adjustment that simultaneously adjusts the height of the armrest and backrest.

15. The chair of claim 1, further comprising an armrest height adjustment.

* * * * *